United States Patent [19]

DeGraw et al.

[11] Patent Number: 4,565,636

[45] **Date of Patent: * Jan. 21, 1986**

[54] SELF-CONTAINED FLOW THROUGH SEWAGE WASTE DISPOSAL SYSTEM

[75] Inventors: Kenneth J. DeGraw, Montvale; Brian Wilcockson, Wayne; Earl W. Nickerson, Ocean City; William R. Bocchini, Wyckoff; Armen Bogossian, Teaneck; Steve Proios, Northvale, all of N.J.

[73] Assignee: American Standard Inc., New York, N.Y.

[ * ] Notice: The portion of the term of this patent subsequent to Jan. 14, 2000 has been disclaimed.

[21] Appl. No.: 550,476

[22] Filed: Nov. 9, 1983

Related U.S. Application Data

[62] Division of Ser. No. 320,599, Nov. 12, 1981, Pat. No. 4,433,443.

[51] Int. Cl.[4] ..... C02F 9/00

[52] U.S. Cl. ..... 210/748; 210/805; 210/806

[58] Field of Search ..... 4/318, 321; 210/805, 210/806, 167, 251, 257.1, 282, 335, 387, 499, 748, 91, 916, 917

[56] References Cited

U.S. PATENT DOCUMENTS

| | | | |
|---|---|---|---|
| 3,585,130 | 6/1971 | Gregory | 210/282 |
| 3,662,888 | 5/1972 | Kemper | 4/318 |
| 3,738,489 | 6/1973 | Kraemer | 4/318 |
| 3,751,735 | 8/1973 | Sargent et al. | 4/318 |
| 3,780,867 | 12/1973 | Zirlis | 210/282 |
| 3,950,251 | 4/1976 | Hiller | 210/282 |

*Primary Examiner*—Ivars Cintins

*Attorney, Agent, or Firm*—Hoffmann, Dilworth, Barrese & Baron

[57] ABSTRACT

A self-contained sewage waste disposal system including a housing structure and a toilet bowl adapted to receive human waste and fluid for diluting the waste, transporting the waste and rinsing the bowl. A removable filter cassette is in the housing in communication with the toilet bowl. Structure is provided for flushing the bowl and dumping the contents into the filter cassette and for subsequent refilling of the bowl. A filter is in the cassette for separating the particles of solid material from the fluid received from the bowl. The solid material is stored in the cassette in a compact manner for subsequent disposal upon removal of the cassette. Pumps and interconnected conduits are in the housing to transport fluid directly from an external source to fill the bowl after a flush, to transport and recirculate filtered fluid through the system for further waste disposal treatment, and to direct the effluent fluid from the system thereafter. Controls are provided to pass the fluid through the system and facilitate the collection and disposal of sewage waste within the system in a predetermined sequence.

12 Claims, 11 Drawing Figures

SELF-CONTAINED FLOW THROUGH SEWAGE WASTE DISPOSAL SYSTEM

This is a division of application Ser. No. 320,599, filed on Nov. 12, 1981, now U.S. Pat. No. 4,433,443.

BACKGROUND OF THE INVENTION

Marine sanitary devices in particular and waste disposal systems in general have been proceeding through an evolutionary process for a number of years. The Environmental Protection Agency (EPA) has issued various specifications regarding requirements for processing liquid and solid human waste as set forth in 33 C.F.R. 159. Sewage of waste disposal basically requires that, under certain circumstances, substantially all of the solid waste must be removed from any liquid discharged from the vessel. An additional requirement of EPA is to reduce fecal coliform bacteria to less than 200 count per 100 milliliters. In many instances recirculation of the fluid, for example water is desirable.

Separation of solid waste and collection can be accomplished in a variety of different well known manners. The difficulty resides in storage and disposal. Clearly improvements in this area are necessary particularly when stringent EPA sanitary regulations are taken into considerations and criteria such as size, cost and efficiency of operation are kept in mind.

Several effective systems are disclosed in commonly owned U.S. Pat. No. 4,393,524 and U.S. Pat. No. 4,519,103.

In addition to the factors taken in consideration in development of those systems, other factors also must be frequently considered. For example, in certain restricting and confined environments, storage of fluid such as water for use in the waste disposal system becomes burdensome and difficult. It would also be advantageous to minimize this difficulty whenever possible, for example, in geographic areas where a large volume of water is immediately and directly available, such as in marine environments like an ocean or a salt water lake. Accordingly, a system that would be designed to draw water directly from the external environment for use during a waste disposal sequence and then to discharge the water from the system back into the environment as acceptable effluent under EPA regulations would be extremely desirable. Elimination of a reservoir would reduce the size of the system and make it attractive to marine-vessels where space is at a premium. With this same thought in mind, it would be helpful if the system could be designed in a modular fashion with many of the components designed as part of readily replaceable modules either for disposal of waste or replacement of components.

SUMMARY OF THE INVENTION

With the above background in mind, it is among the primary objectives of the present invention to provide a system for processing liquid and solid human waste in a manner consistent with stringent requirements of the EPA. The system includes a self-contained unit including a removable module disposable filter cassette designed to achieve "white glove" servicing of the system. The system is compact and the cassette can be interconnected with a toilet bowl and packaged beneath the bowl in a space saving arrangement which is particularly useful in confined areas, for example in marine use. Additionally, other components of the system are also formed in a compact and modular nature for space saving advantages as well as ease of maintenance. The system of the present invention is designed for use as a flow through system where virtually no fluid volume is retained within the system between uses. It is adapted for connection to an external source such as a salt water body and when actuated will immediately draw the salt water into the system during the waste disposal sequence for a relatively rapid and efficient time and operational sequence. At the end of that sequence, the salt water which now contains waste material is discharged from the system as effluent fluid. A predetermined amount of clean water from the water source is retained in the bowl between uses in preparation for the next use. The design of this system is such that, with the use of external salt water, a minimum number of components are required for the waste disposal treatment sequence and any difficulties encountered in storing treated fluid within the system are eliminated.

It is an objective of the present invention to provide a modular system whereby the filter cassette within the system can be used for efficient storage of solid waste and then removed and replaced when full. Other portions of the system are modular and compact so that they can be readily replaced for maintenance purposes.

An objective is to provide a compact inexpensive system utilizing low cost filtration materials to achieve minimum cost per flush. The system is energy efficient and only a small amount of electrical power is required for use.

A further objective is to provide a system in which solid waste is effectively filtered from fluid waste and the filtered fluid is thereafter retained separate from the collected solids to prevent recontamination and is further filtered and then discharged from the system as effluent. This is accomplished by a uniquely designed filter cassette and recirculation system elements.

The system of the present invention is designed with separate pumps for rinse and refill and recirculation and removal of filtered fluid from the system. The waste disposal system is unitary and self-contained with only the necessity of external fluid being introduced for the sanitation and filtering sequence and then discharged.

Danger of recontamination of the filtered fluid is eliminated since as soon as the solid waste has been collected and the fluid has been properly treated it is discharged from the system as effluent without the danger of contacting and being recontaminated by the separated solids. This is particularly useful under agitation conditions, for example, the pitch and roll encountered in a marine vessel.

The cassette is designed to roll filter material about a spindle or take-up roll assembly. Solid waste material is separated and rolled up into the take-up roll. Controls are provided to intitiate rolling of a predetermined amount of filter material onto the take-up roll after a flush sequence and indicating means is provided to denote a completion of use of the filter material in the cassette. The cassette can then be removed and replaced and the system used again in the same manner. In this way, the removed filter cassette can be disposed of in a simple, clean and efficient manner. There is no necessity to open the cassette or gain access to the interior thereof.

The configuration of the cassette is such that the filtered fluid is directed away from the separated solid waste material and is quickly and efficiently pumped from the cassette. The fluid is then recirculated through the system for a predetermined period of time for further filtering in the cassette and ultimately is discharged from the system as acceptably clean effluent.

The cassette take up roll for the filter material contained therein has a polyagonal configuration, for example triangular which facilitates directing the larger portions of the solid waste on the filter material with the material wrapping around the roll for collection and storage.

It is an objective of the invention to provide unique controls including a particular arrangement of pumps, valves and interconnected conduits to facilitate a predetermined and timed sequence of operation for the self-contained sewage waste disposal system. The system is designed so that the toilet bowl is rinsed and refilled, the flushed fluid containing solid waste is passed through a filter cassette where the solid waste is substantially entirely removed and the fluid waste is maintained separately from the solid waste and recirculated through the filtering system in the cassette for further filtration for a predetermined period of time and thereafter discharged from the system as effluent. The system is a flow-through system whereby the external fluid source, such as a salt water body, provides fluid directly to the system for the waste treatment sequence and then is disposed and discharged from the system as effluent. No untreated, partially or fully treated volume of fluid is stored within the system.

A processing module is provided as a separate module component of the system and includes a flush valve, a recirculation valve, and an effluent valve to provide the necessary fluid paths for the fluid passing through the system and a sanitizing and deodorizing unit. The sanitizing and deodorizing unit can be any one of a number of different types of units used for that purpose. For example, it can be in the form of an electrolytic cell, a unit employing ozone generation, or a unit utilizing ultra violet radiation. The sanitizing and deodorizing unit can also employ chemical disinfection. For example, a hypochlorite solution, either solid or liquid can be used. Alternatively, iodine, bromine, mecuric salt, or silver salt solutions can be used. Another type of chemical disinfection is by pH adjustment. Alternatively, the sanitation module can be one which employs heat. For example, the heat could be produced by electrical resistance, combustion or chemical reaction. With these other sanitizing methods, salt water is not needed.

The controls for operating the system can be conventional types of electrical or pneumatic controls which conveniently provide for the desired program timing and sequence of operation.

The present system is capable of being utilized in marine environments, camping sites, construction locations, mobile vehicles, and other similar places where self-contained waste disposal systems are applicable.

In summary, a self-contained sewage waste disposal system is provided including a housing structure and a toilet bowl adapted to receive human waste and fluid for diluting the waste, transporting the waste and rinsing the bowl. The system includes a removable filter cassette in the housing in communication with the toilet bowl. Means is provided for flushing the bowl and dumping the contents into the filter cassette and for subsequent refilling of the bowl. A filter in the cassette separates the particles of solid material from the fluid received from the bowl. Storage means in the cassette stores the solid material in a compact manner for subsequent disposal upon removal of the cassette. Pump means is provided including interconnected conduits in the housing to transport fluid directly from an external source to fill the bowl after a flush, to transport and recirculate filtered fluid through the system for further waste disposal treatment and to direct the effluent fluid from the system thereafter. Control means is provided to pass the fluid through the system to facilitate the collection and disposal of sewage waste within the system in a predetermined sequence.

With the above objectives among others in mind, reference is made to the attached drawings.

DETAILED DESCRIPTION

Figure 1:
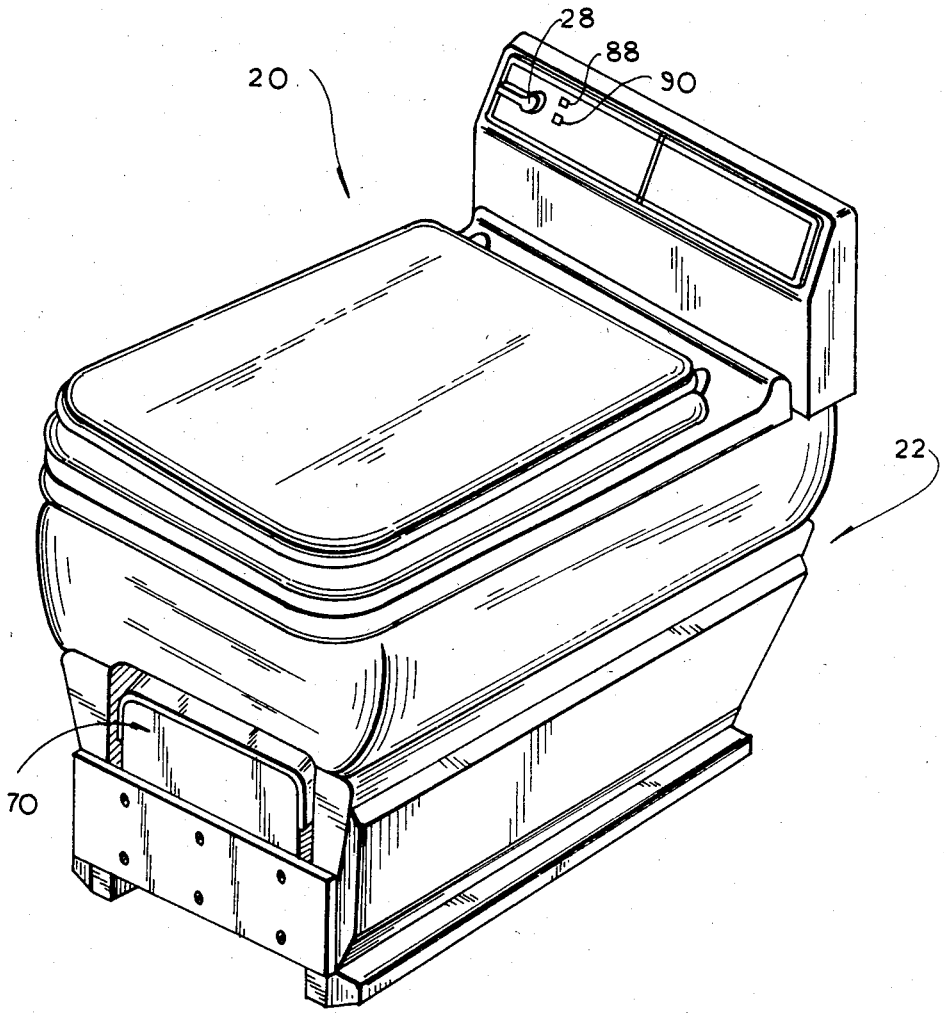
FIG. 1 is a perspective view of the self-contained sewage waste disposal system of the present invention.
Figure 2:
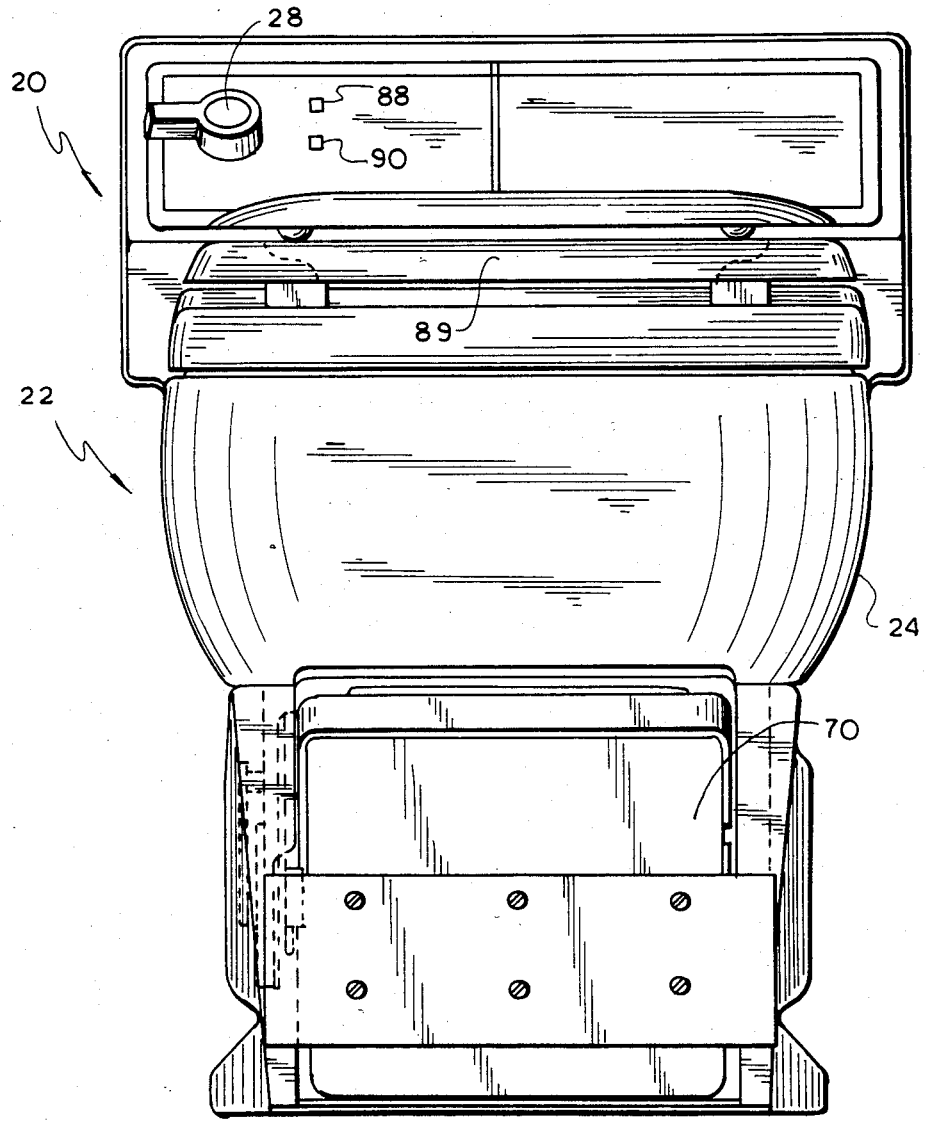
FIG. 2 is a front elevation view thereof.
Figure 3:
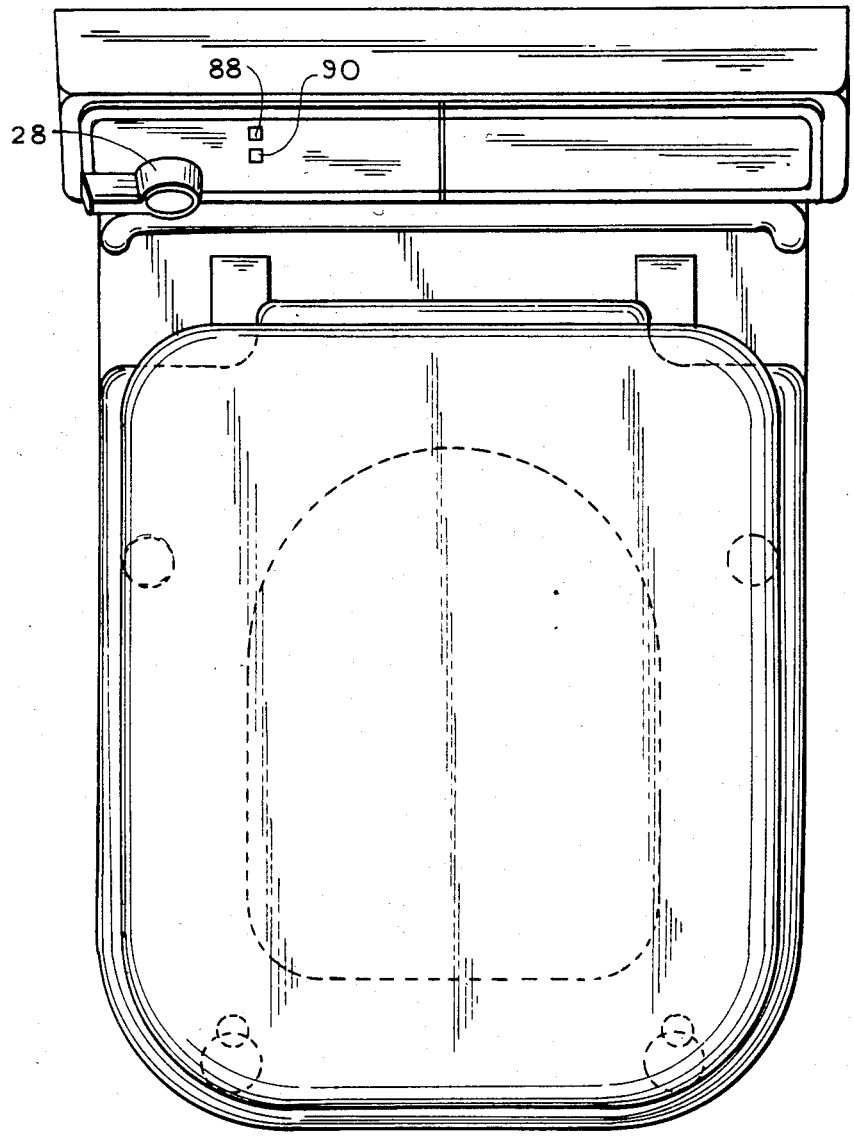
FIG. 3 is a top plan view therof.
Figure 4:
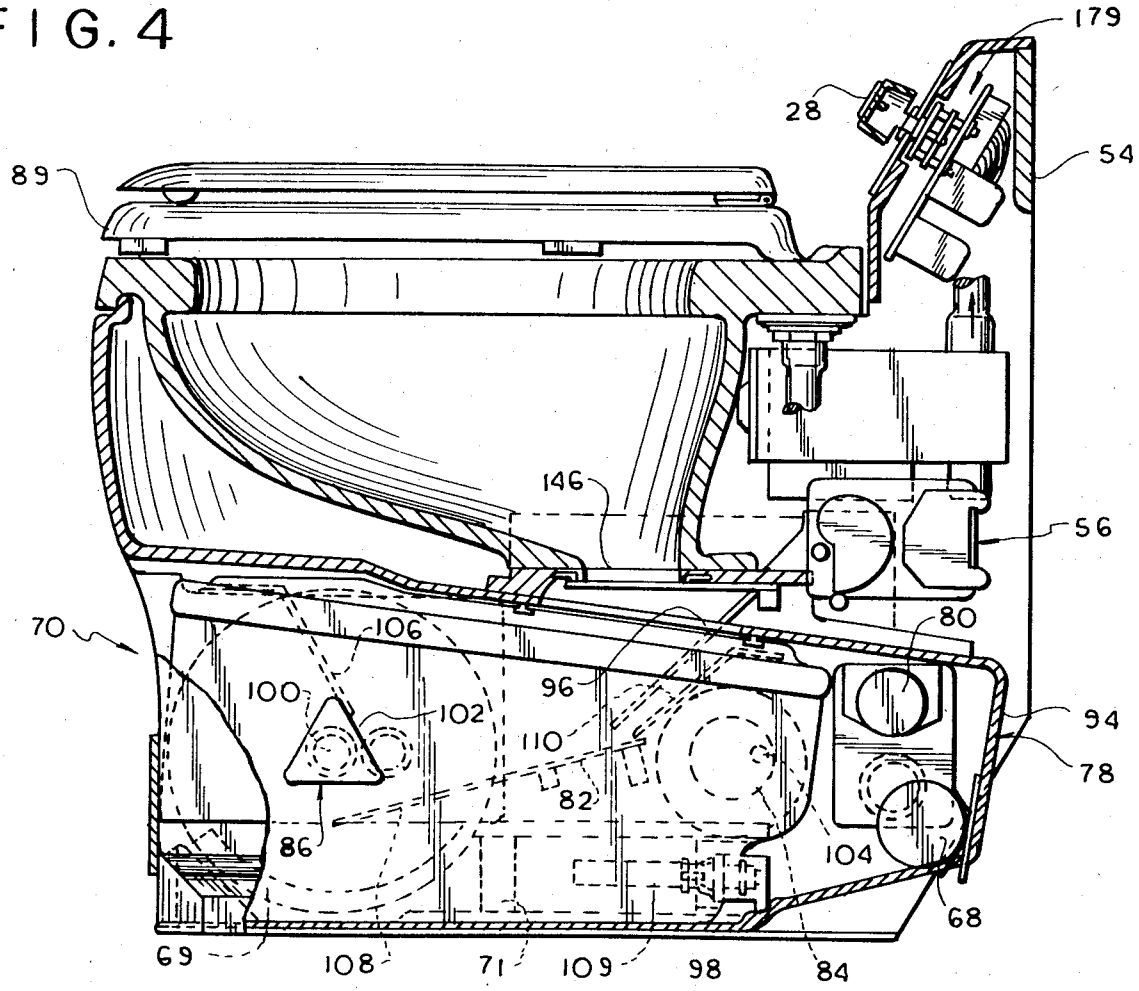
FIG. 4 is a sectional side elevation view thereof.
Figure 5:
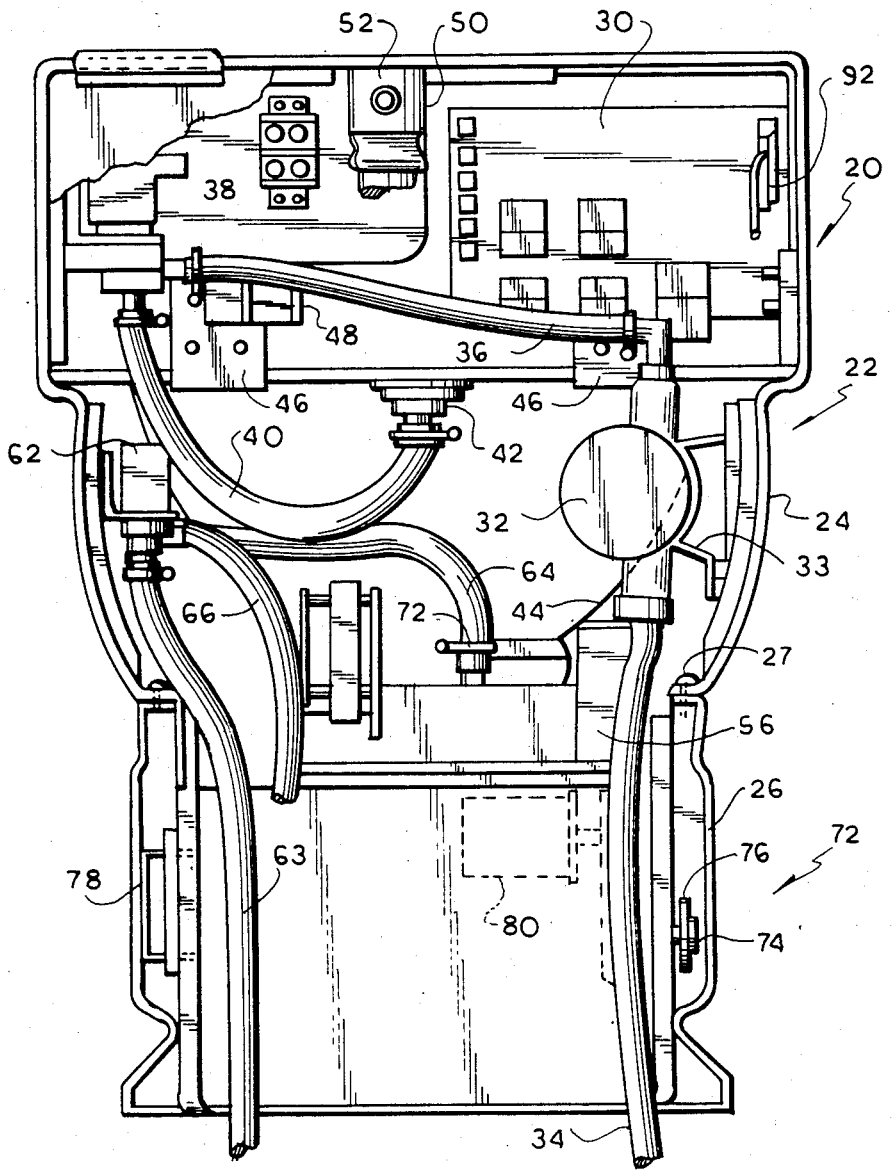
FIG. 5 is a sectional rear elevation view thereof with arrows showing the direction of fluid flow through the system.

System 20 as shown includes a compact housing structure 22 for the system components as well as providing a weight support contoured for the user. The components of system 20 are incorporated within the housing and thus it is an entirely self-contained system designed for disposal of sewage waste. In this manner, it is particularly useful in the marine environment since it will satisfy certain stringent EPA requirements for handling of human waste and alleviate the necessity of fluid storage in that it will operate with a flush cycle including the intake of salt water at the beginning of the cycle and the discharge of effluent clean salt water at the end of the flush cycle.

System 20 is shown in its entirety in FIGS. 1–5 with the basic parts of the system within housing 22. Housing 22 includes an upper housing subassembly 24 and side panels 26. The upper housing and side panels are interconnected in a suitable manner such as by bolt assemblies 27. The major ccomponents of the upper subassembly housing include a flush handle 28 mounted on the front exterior of the housing and interconnected with the electronic controls within the system to operate certain portions of the system when the flush lever is depressed. An electronic control panel, module or PCB assembly 30 is mounted in conventional fashion on the interior of the upper housing and contains the electrical controls for the system. A rinse pump 32 is mounted below control panel 30 in the upper housing by conventional means such as bracket 33 affixed to the side wall of the upper housing. An inlet tube 34 extends into the housing from the exterior thereof and communicates with the rinse pump 32. The exit end of the rinse pump 32 is interconnected with a conduit 36 in the upper housing which is in turn connected with a solenoid valve 38. The other end of the valve 38 has a tube 40 connected thereto extending into communication with a fitting 42 on toilet bowl assembly 44. The fitting 42 is in communication with a flush ring on the bowl 44 for rinse and refill purposes. A suitable arrangement of bowl brackets 46 are provided for mounting the vitreous china bowl assembly 44 within the upper housing 24. Two circuit breakers 48 and 49 are provided in the upper housing adjacent to the solenoid valve 38.

An interconnected venting arrangement to provide suitable vent means for the system is at the upper end of the upper housing assembly 24 and includes a vent hose 50 and a vent connector 52.

The upper housing assembly includes a rear access panel 54 which is removable to permit access to the contents of the interior of the upper housing assembly 24.

Also removably mounted in the upper housing assembly is a removable processing module 56. The processing module 56 is removable for ease of servicing and replacement when desired. It is removable by opening the rear access panel 54. The processing module has among its components a flush valve assembly 58 and an electrolytic cell assembly 60. The module 56 is interconnectable with a solenoid valve assembly 62 which are 2-two way valves operating as recirculation and effluent valves. This is an alternate means of flow direction replacing the valves in processing module 56. A tube 64 connects the solenoid valve assembly 62 to the processing module 56 and particularly the electrolytic cell 60 within the module. A conduit 66 connects the valve assembly 62 to the pump 68 in the lower housing enclosed by side panels 26 which in turn is connected to the filter cassette assembly 70 removably mounted in the lower housing enclosed by side panels 26. All of the tubes within the housing interconnecting the components for fluid flow are mounted to appropriate fittings in a conventional manner such as by overlying frictional interengagement and retained in that position by a suitable clamp and screw assembly 72.

The lower housing 25 holds a number of major components of the system including pump 68 and cassette assembly 70. The cassette 70 is removably interconnected with a cassette filter drive mechanism 72 which includes a sprocket drive 74 and a chain 76 interconnected therewith. A reed switch 78 is mounted on the lower housing. Chain 76 extends into interconnection with the drive shaft of a conventional drive motor 80 mounted in lower housing 25.

The replaceable cassette assembly 70 contains a filter 82, a supply roll 84 for the filter screen 82 and a take-up roll assembly 86.

A conventional seat and cover assembly 89 is mounted on bowl assembly 44.

Adjacent to flush lever 28 on the front exterior of the upper housing is a pair of indicator lights, an upper indicator light 88 indicating operation of the processing sequence when lit and a lower indicator light 90 indicating the need to change the filter cassette when lit. On the interior of the upper housing assembly is a harness 92 which interconnects the wiring to the control panel 30.

The cassette assembly 70 includes an outer housing 94 having a configuration generally which facilitates its use in occupying the least amount of space and keeping with the compact nature of the system 20. Additionally, the configuration is such that filtered fluid is isolated from the danger of contamination from separated waste solids within the cassette. The housing 94 includes an entrance opening 96 in its upper surface and a fluid disconnect 98 at its rear lower end for interconnection with a hose to pump 68 for recirculation and the further treatment and eventual removal of fluid from the system as effluent fluid.

Take-up roll assembly 86 includes a central shaft 100 and a polyagonally shaped member 102 mounted thereon to rotate therewith. In the embodiment shown, the member 102 has a triangular configuration which facilitates accumulation of solid waste and filter material as it is being accumulated on the take up roll assembly 84 for eventual disposal. Shaft 100 with interconnected sprockets is releasably interconnected with sprocket drive 74 to be rotated through the use of chain 76 by activation of drive motor 80.

The supply roll 84 containing the supply of filter material 82 has a suitable piece of magnetic material 104 thereon for use in determining when the filter roll 84 has been rotated to supply filter material and when the filter material is exhausted. The magnet or magnetic material 104 is sensed by an appropriate electrical switch in the circuitry.

A splash guard 106 overlies the take up roll assemnbly 86 on the interior of the cassette and is mounted in conventional fashion on the housing 94 in position to guard against splashing and contaminating dissemination of the separated and collected waste solids. A combination guideway and pressure plate 108 is mounted in alignment with the filter material 82 from the supply roll 84 and serves to guide the material into engagement with the take-up roll assembly 86. The guideway 108 is mounted so that it will act as a pressure plate in position to apply pressure to the collected filtered materials on the take-up roll assembly 86 as the roll expands in size thereby facilitating the retention of the waste and collected filter material on the roll. A take up tube 109 within the bottom of the cassette is interconnected with the disconnect 98 to provide an exit path for the filtered fluid.

A splash guard 110 is mounted on the interior of the housing 94 of the cassette adjacent to the upper opening 96 in the cassette and in position to extend downwardly and inwardly into contact with the filter material 82 coming off the supply roll 84. Splash guard 110 helps in preventing waste material entering through upper access opening 96 from contacting and contaminating the filter material contained on supply roll 84 and otherwise contaminating portions of the interior of the cassette 70 remote from the take-up roll 86 where the waste is to be collected.

An inlet filter pad 69 is incorporated in cassette assembly 70 to prevent solid particles from bypassing filter 82 and entering pump 68. Inlet filter pad 69 is held in position by filter pad supports 71.

The cassette 70 is removably replaceable through an opening in the housing assembly. A suitable removable plug can be taken out of the cassette to expose opening 96 before insertion and can be replaced after removal of the cassette to seal it for transportation and disposal. It is ready for use upon easy connection of the filter drive shaft 100 with the drive assembly on the housing and connection of the disconnect 98 with the conduit to the pump 68.

Figure 6:
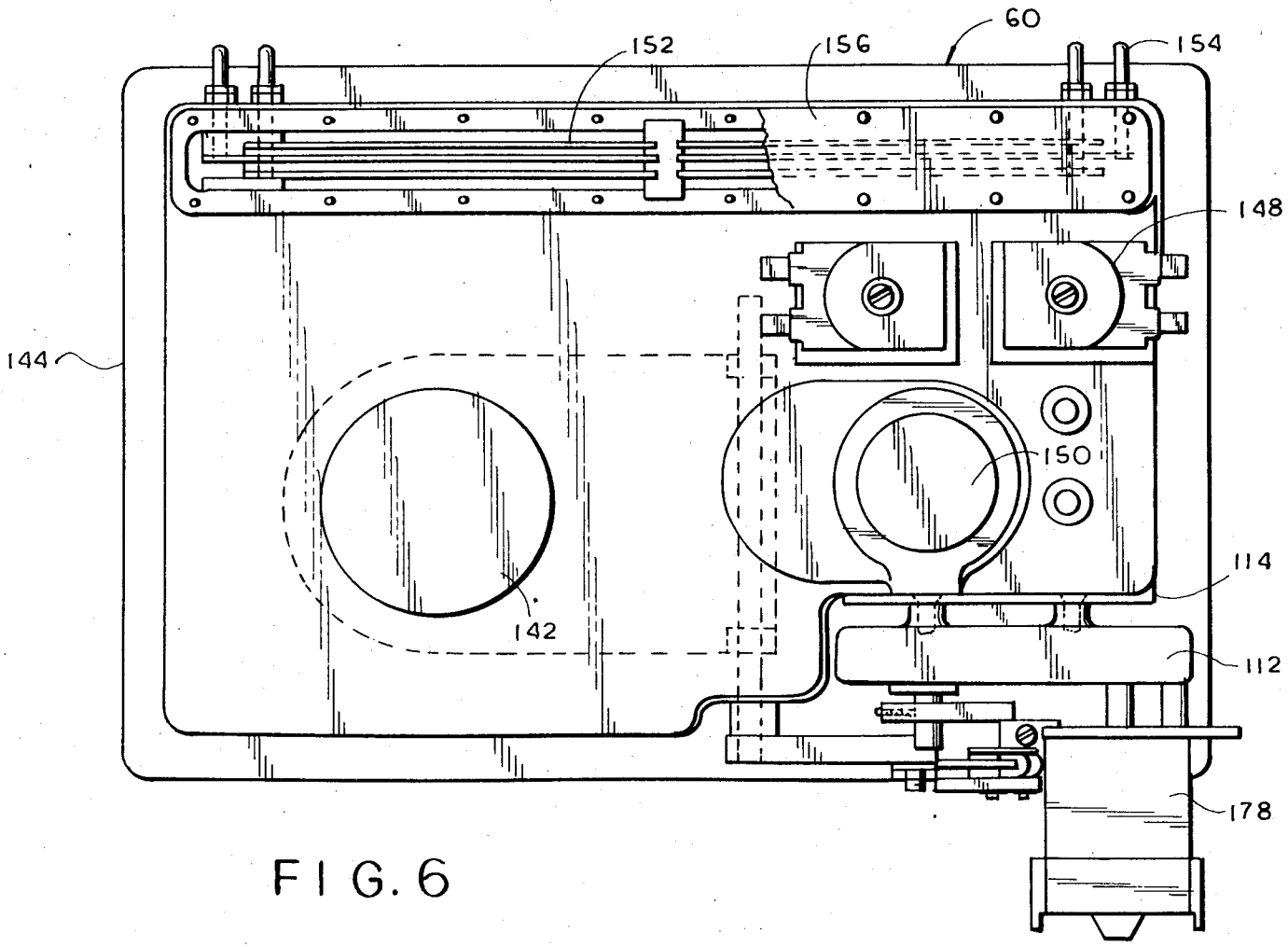
FIG. 6 is a top plan view of the processing module portion of the system.
Figure 7:
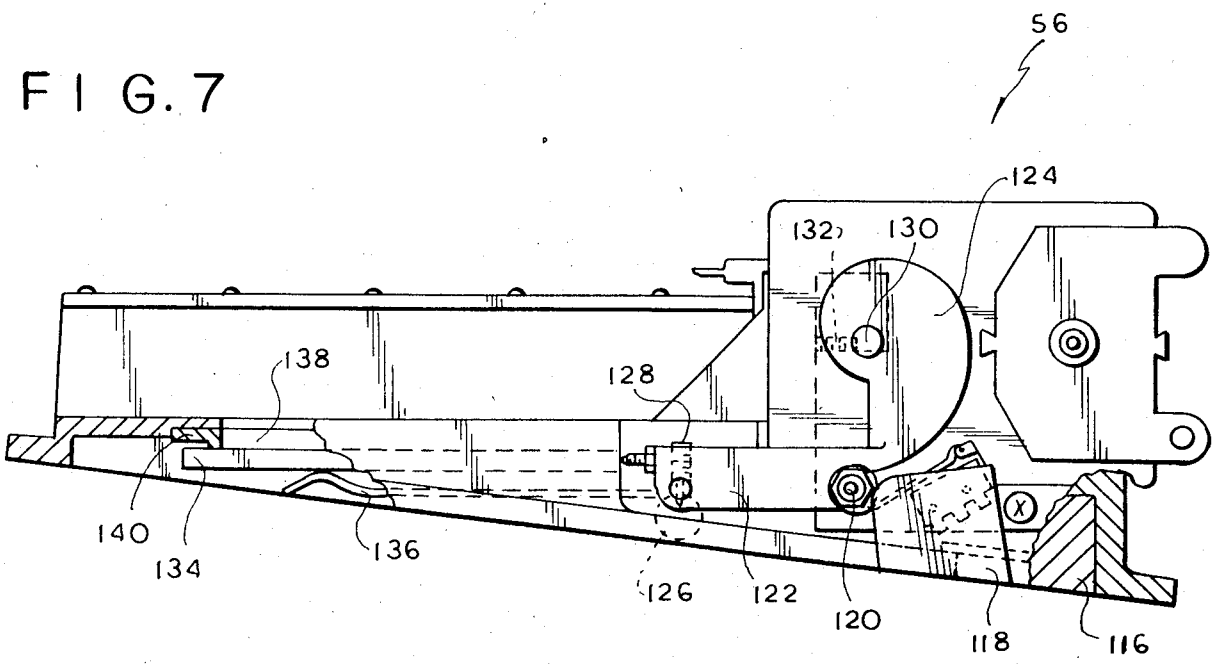
FIG. 7 is a sectional side elevation view thereof.

The processing manifold or module 56 is show in detail in FIGS. 6 and 7. The module includes motor 178 which is interconnected with the module 56 through motor speed reduce 112 and motor mounting plate 114 on the module. The module also includes a pad chamber 116, a switch assembly 118, a cam follower 120, a cam follower arm 122 and a cam 124. The cam follower arm is mounted at one end to a shaft 126 with the assistance of a set screw 128 and at the other end to the cam follower 120. Cam 124 is mounted to rotate about shaft 130 and is affixed thereto by means of set screw 132. The module 56 includes the flush valve assembly 58 and for that purpose a flapper 134 is normally engaged by tensioner 136 to overlie and seal opening 138 in the bottom of the manifold. A sealing gasket 140 is placed adjacent the peripheral edge of opening 138 for engagement with the flapper 134 to retain the discharge orifice in the manifold for the flush valve assembly normally in the closed position. An opening 142 is in the upper side of the manifold housing 144 for alignment with the discharge opening 146 in the toilet bowl assembly so that waste material can be flushed from the toilet bowl through discharge opening 146 in the bowl and through aligned openings 142 and 138 in the manifold when flapper 134 is shifted to the open position. When the flapper 134 is in the closed position, the bowl can be refilled with water for further use.

The valve assembly including flapper 134 is electrically operated upon an appropriate signal from the control board through the use of motor 178. An entrance opening 150 is in the module to provide introduction of a vent to the interior of cassette 70 for evacuation of displaced air after flushing system 20. Fluid is introduced to the interior of module 56 through solenoid valves 148. The fluid is subjected to treatment by an electrolytic cell 60 included in the module. The electrolytic cell includes a plurality of electrodes 152 and a plurality of stubs 154 for electrical connections to the electrodes. The electrodes are housed within a casing 156 with access being provided to the fluid circulating through the module for treatment of that fluid.

The flush valve assembly 58 formed as part of the module is electrically operated to operate in sequence along with the entrance, treatment and exit of recirculation fluid through the module. The module can be removed and replaced easily and efficiently when it is deemed to be desirable.

The toilet bowl assembly includes a conventional flush ring surrounding the upper rim portion of the bowl and the flush ring is conventionally connected for introduction of fluid to rinse the bowl. Fluid introduced through the flush ring into the bowl is normally retained in the bowl for dilution of the waste. This fluid adds in the transport of the waste material from the bowl through the flush valve assembly 58 into the cassette 70 at the same time rinsing and cleaning the bowl. Seat and cover assembly 89 is pivotable between the open and closed position in a conventional manner. The pumps in the system including pumps 68, and 32 are commercially available products and are designed to pump the fluid through the system. This includes transporting fluid from the exterior of the system to rinse and refill the toilet bowl after a flush, transporting filtered fluid from the cassette through a recirculation pathway, and transporting the fully treated fluid from the system as effluent fluid. All of the components through which fluid is directed in operation of the system are appropriately connected by suitable conduits or hoses mounted in a conventional manner to each interconnected element.

Figure 8:
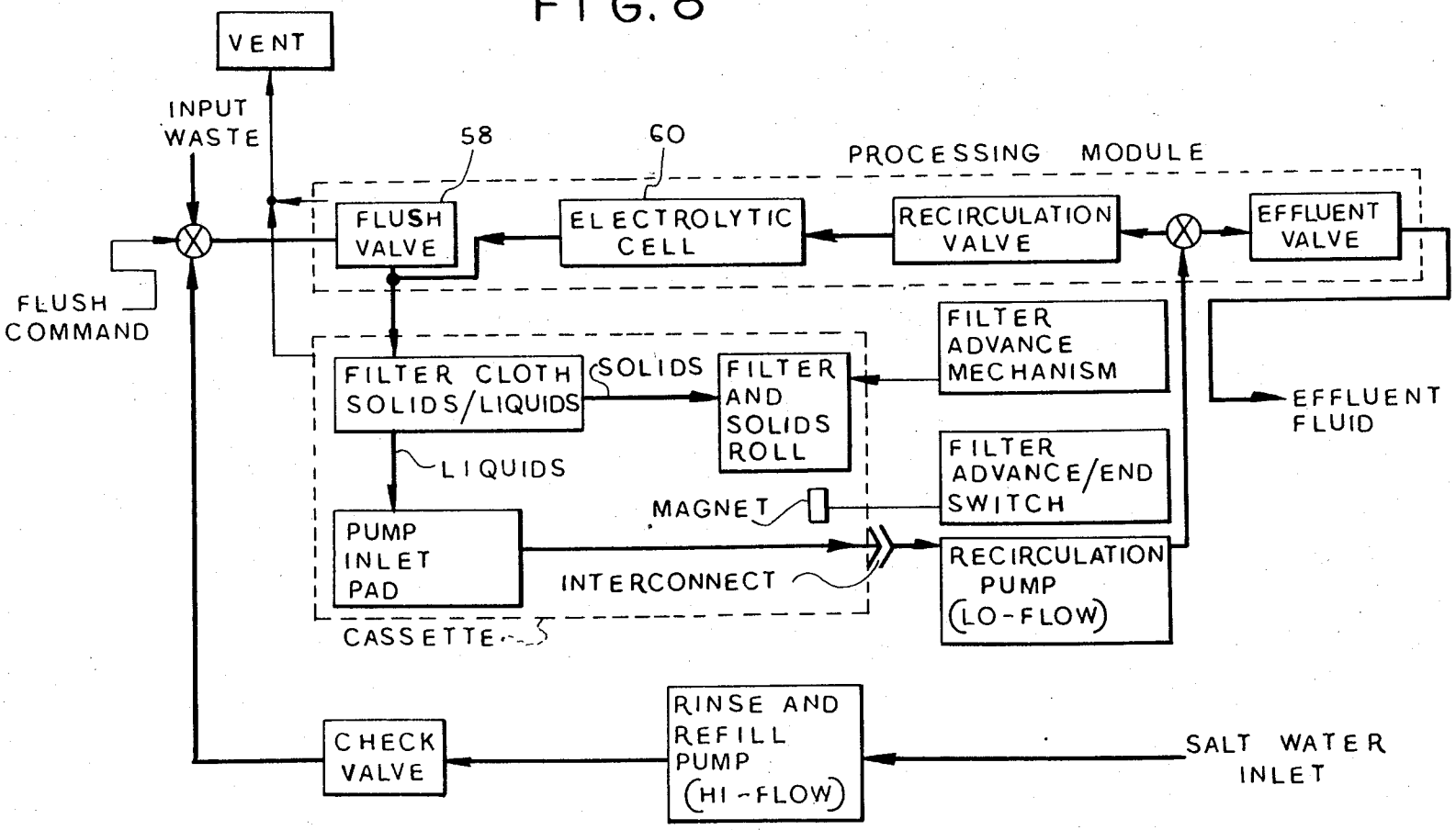
FIG. 8 is a block diagram of the sequence of operations of the system.
Figure 9A:
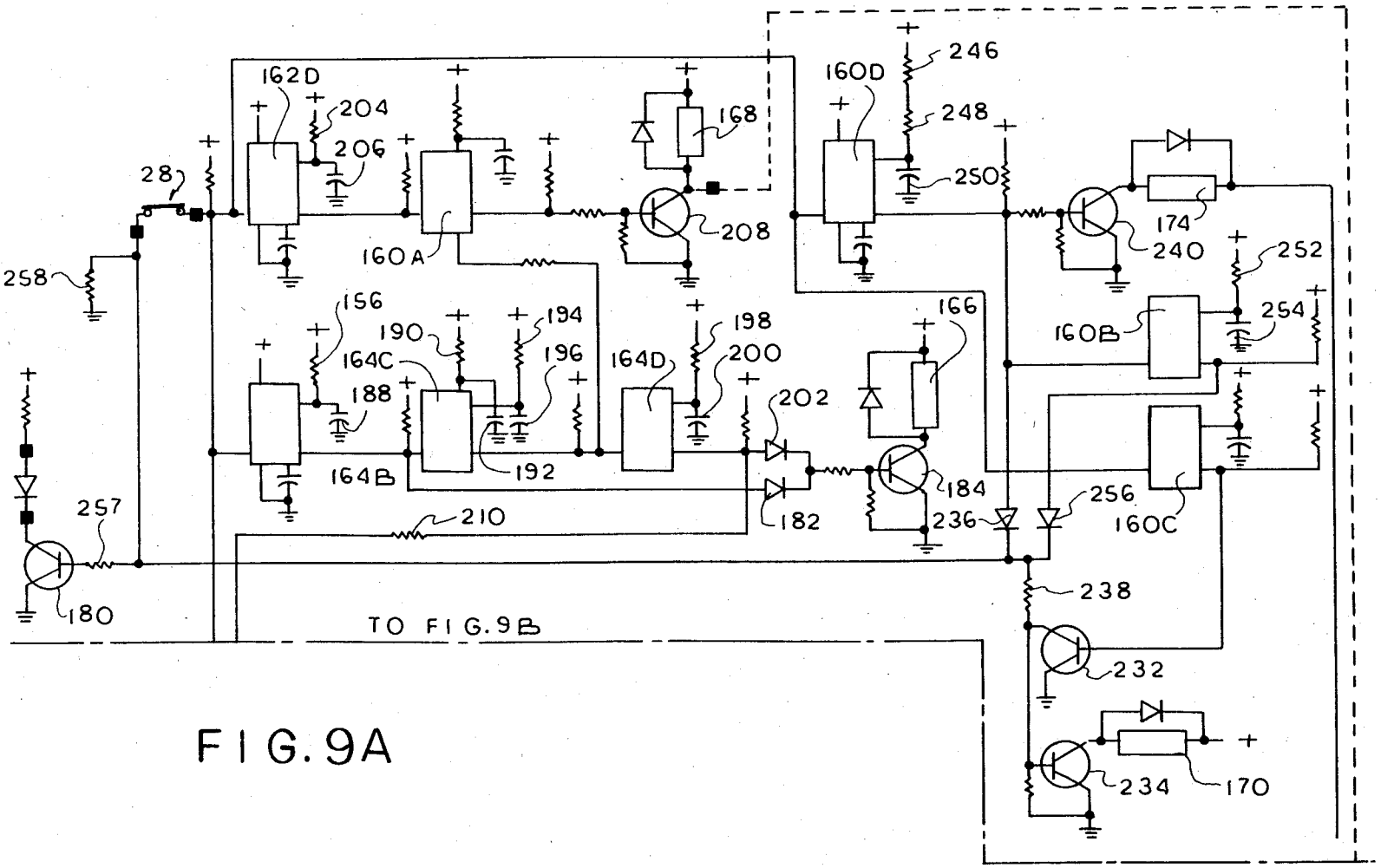
FIGS. 9A and 9B is a schematic view of the electrical circuitry of the system.
Figure 9B:
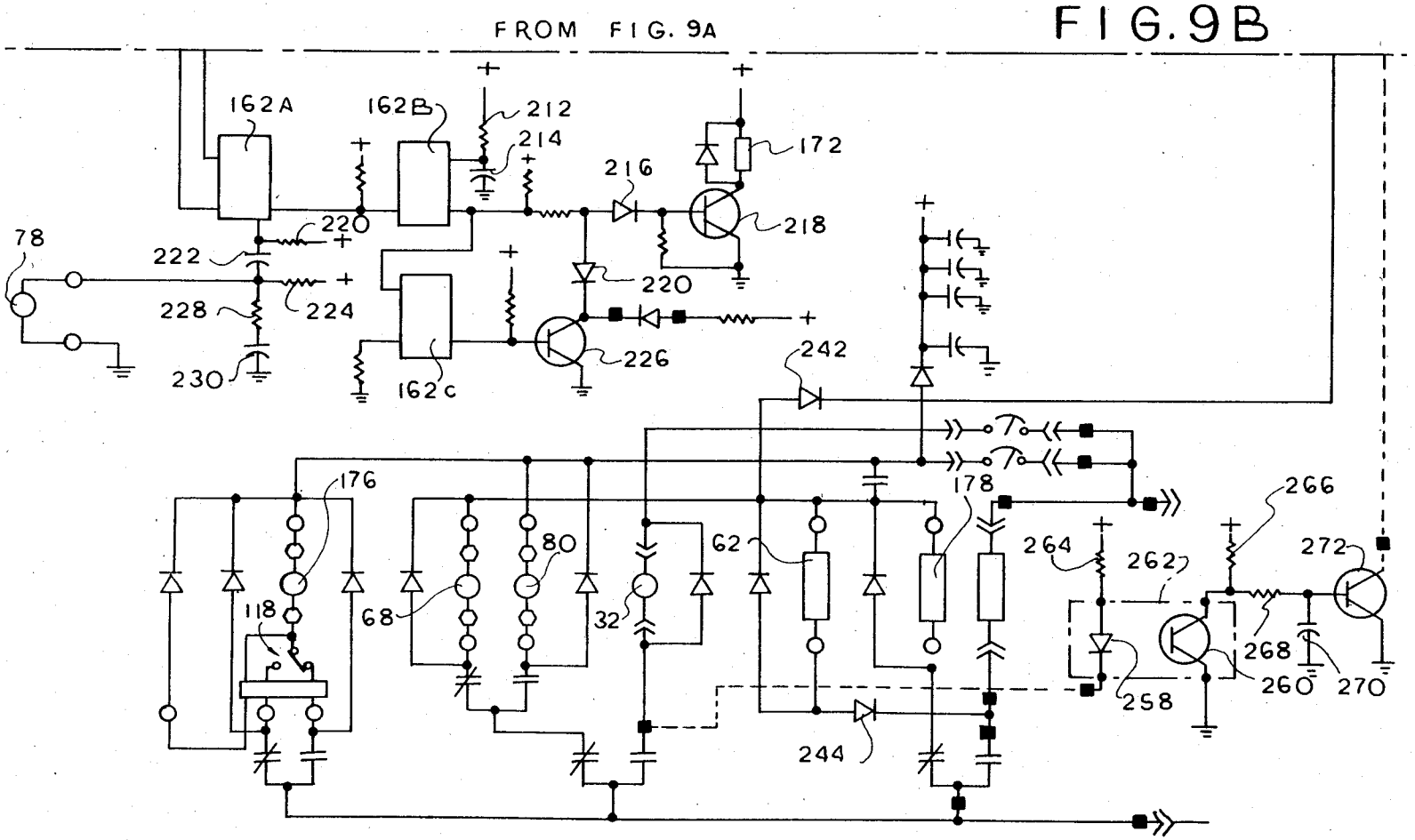
Figure 10:
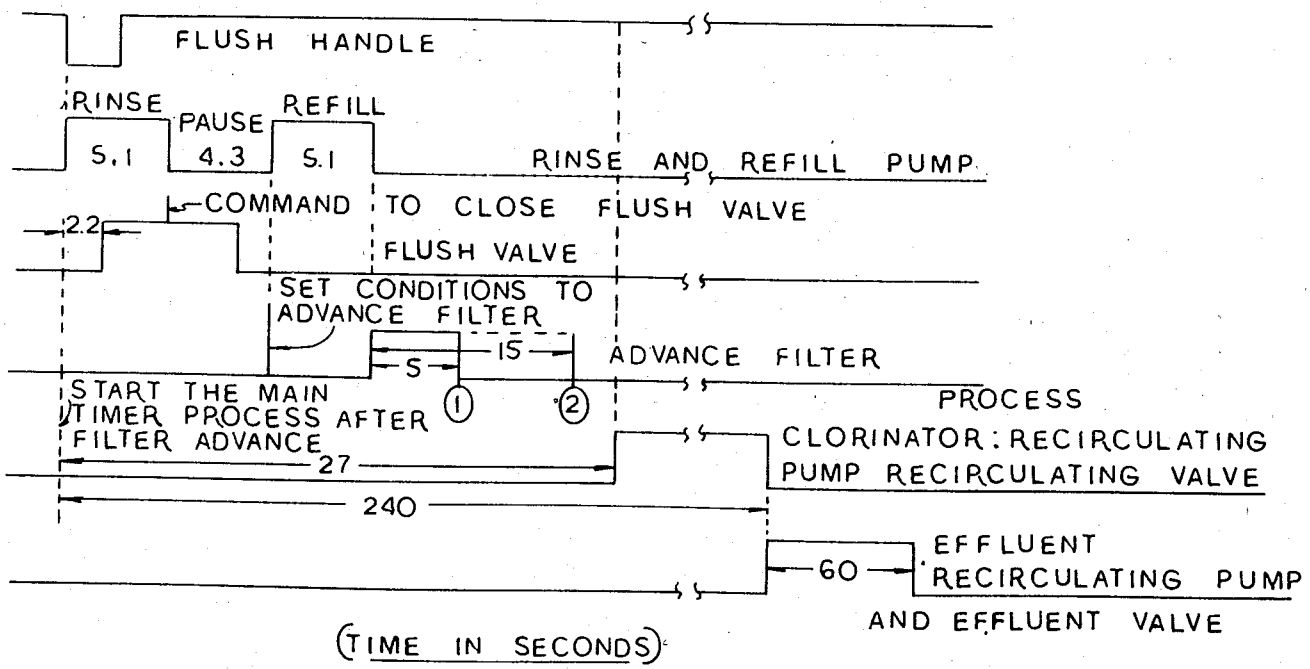
FIG. 10 is a schematic view of the functional timing sequence of the system.

Operation of the system can be best understood when considered in light of the flow diagram of FIG. 8, the schematic electrical circuitry of FIGS. 9A and 9B and the timing diagram of FIG. 10. In general, the system is set up for use by placing a new cassette assembly 70 within the receiving recess in the lower housing 25 through the access opening therein. The cassette is positioned until the opening 96 in its upper end is in alignment with the discharge opening 146 in the toilet bowl assembly. A processing module 56 is also inserted through an access opening in the rear of the upper housing 24. The module 56 is inserted until upper opening 142 and lower opening 138 in the flush valve assembly 58 are in alignment with the discharge opening 146 of the toilet bowl assembly and the opening 96 into the cassette assembly. Suitable electrical connections and hose connections are made to the module 56 to integrate the module with the system in a quick and efficient manner. Similarly, the motor drive assembly including sprocket drive 74 and chain 76 is interconnected with the shaft 100 with its interconnected sprocket (not shown) extending from the side wall of the cassette so as to form a drive mechanism for take-up roll assembly 86. The appropriate hose is connected to fluid disconnect 98 to provide means for removal of fluid from the cassette. The system is then ready for use.

In general, the basic cycle starts with a downward action on the flush lever 28 which starts the rinse and refill pump 32 followed by the opening of the flush valve assembly 58. This allows the bowl contents to fall into the cassette 70 through opening 96. Rinse and refill pump 32 then stops and flush valve assembly 58 closes. The refill pump 32 turns on again long enough to rfill the bowl. The filter advancement motor 80 meanwhile is advancing the filter 82 in the cassette 70. Then the recirculation pump 68 turns on recirculating the fluid from the cassette 70 through the pump 68 and recirculation valve of valve assembly 62 and through the electrolytic cell 60 in the processing module 56 and back into the cassette 70 through an appropriate aperture in the module in alignment with an aperture back into the cassette. After a predetermined period of time, for example 4 minutes, the recirculation valve of valve assembly 62 closes the passageway to the processing module and opens the passageway to the exterior of the system thereby pumping the fluid out as effluent from the system. Pump 68 continues until the system is empty and ready for the next cycle.

In detail, the timing functions are accomplished with the assistance of three NE558 monolithic timing devices 160, 162, and 164. Each timing device contains four circuits which can be used to produce four entirely independent timing functions. A capacitor and resistor combination achieves the timing function. Each of the four circuits in connection with each timing device is identified by the subscript letters a through d respectively on FIGS. 9A and 9B. In the present system, this device is used primarily in a monostable (1 shot time delay) mode. The same device is also used as a set-reset flip-flop. This is achieved by leaving the timing capacitor out, therefore, essentially the monostable has a timing of 0 seconds.

When any of the timing devices 160, 162 and 164 is used in the one shot mode operation, it is necessary to supply a resistor and capacitor for timing. The time period is equal to the product of R (ohms) and C (farads). Since the output structure of the timing device is an open collector, it requires an output pull-up resistor. The output is normally low and is switched high when triggered. A trigger (start the timing) is achieved on the falling edge of the trigger pulse only, after previously being high. A reset is also available in each device to reset all sections simultaneously to an output low state. When the reset function is low, all outputs are set low and the trigger is inhibited.

Whenever the timing output of a NE558 timing device such as devices 160, 162 and 164 is needed to drive a relay, a high gain/high power D4OKI NPN transistor is used. Diodes are used across each relay coil to supress the transient voltage produced when de-energized. Diodes are also used across motors, pumps, and valves, to supress transient voltages.

Other components of the circuit include rinse pump relay 166, flush valve relay 168, cassette process relay 170, filter advance relay 172, electrolytic cell relay 174, flush valve index switch 118, flush valve motor 176, rinse pump 32, recirculating pump 68, recirculating valve 61, effluent valve 178, and filter advance motor 80. The flush lever 28 is attached to a spring return rotary switch 179. When the flush lever is turned downwards, it starts the rinse pump function through timing device 164B, the flush valve delay function through timing device 162D, the conditions to advance the filter through timing device 162A, the delay process function through timing device 160C, the main timer through timing device 160D, the effluent timer through timing device 160B, and the lever disable function through transistor 180.

In the rinse pump function, timing device 164B output goes high immediately upon turning the flush lever 28 downwards. Through diode 182, the output of device 164B saturates transistor 184 that pulls in rinse pump relay 166. The timing device 164B period is timed as determined by resistor 186 and capacitor 188 for 5.1 seconds. That is, the rinse pump 32 will push water from the sea through inlet tubes 34, 36 and 40 into the bowl for 5.1 seconds. This is the rinse interval of the rinse pump function. When timing device 164B completes its time period, its output goes low (to 0 volts). This is a command for timing device 164C to go high and stay high as determined by its resistor 190 and capacitor 192 and resistor 194 and capacitor 196 arrangements, for 4.3 seconds. This is the pause interval of the rinse pump function. The functional timing sequences can be easily seen in FIG. 10. When timing device 164C completed its time period, its output goes low. This is a command for timing device 164d to go high, and stay high for 5.1 seconds as determined by resistor 198 and capacitor 200. Through diode 202, the output of timing device 164D saturates transistor 184 again to pull-in rinse pump relay 166. Rinse pump 32 pushes water into the bowl this time to refill the bowl to its wet level determined by the timing device 164D period as set by resistor 198 and capacitor 200. This is the refill interval of the rinse pump function.

In the flush valve delay function, the flush lever 28 also starts the timing device 162D timing as set by resistor 204 and capacitor 206, its output going high and staying high for 2.2 seconds. At the end of the timing period of device 162D, timing device 160A goes high which saturates transistor 208 pulling in flush valve relay 168.

Flush valve relay 168, through the normally open contact of the flush valve index switch 118, puts voltage across the flush valve motor 176. Flush valve motor 176 drives the flush valve mechanism off its cam deactivating the flush valve index switch 118 which removes power from the flush valve motor 176, and allows the flush valve mechanism to snap the flush valve flapper 134 open.

This function together with the rinse interval of the rinse pump function achieves the following: the rinse pump 32 starts pushing water into the bowl, 2.2 seconds later the flush valve 58 snaps open unloading the bowl contents into the cassette 70 below, and rinses the bowl clean.

The conditions to advance the filter in the cassette include timing device 162A flip-flop being set by the lever switch. When the refill interval of the rinse pump function ends, device 162A resets through resistor 210. Device 162A reset is the command for device 162B to start its timing period of 15 seconds as determined by resistor 212 and capacitor 214. Through diode 216, transistor 218 saturates energizing filter advance relay 172.

With filter advance relay 172 energized, the filter advancement motor 80 will be powered as soon as rinse pump relay 166 ends its refill interval. The filter advance motor 80 advances the filter mechanism and cassette filter take-up assembly 86. This causes the filter roll 84 (provided it has some filter material 82 wrapped around it) to rotate. Filter roll 84 supports a small magnet 104 which also rotates. The reed switch assembly 78 contains three reed switches 120 degrees apart in a circle and senses that the magnet 104 has moved off one reed then onto another (it traveled 120 degrees) and, together with resistor 220, capacitor 222, and resistor 224 produce a reset pulse to reset timing device 162. Note that the reset pulse is produced only when all reeds are open, that is when the magnet 104 is not in the vicinity of a reed, and then any one is closed, that is when the magnet 104 is on top of a reed.

If the reed switch assembly 78 cannot produce a reset pulse for timing device 162, such as when the cassette is out of filter material 82, then timing device 162B will complete its 15 second timing period. The timing device 162B output then becomes a set command for flip-flop 162C. Device 162C saturates transistor 226, lights the red LED forming the change cassette light 90, and, through diode 221, prevents filter advance relay 172 from energizing. It should be noted that the reed switch assembly 78 cannot produce a reset pulse for resetting timing device 162 under the following conditions: (1) the cassette is out of filter material 82, (2) there is not enough filter material 82 for a 120 degree travel, (3) the cassette has filter material 82, however, the solids fill up the take-up roll cavity, thus stalling the filter advance motor 80, and (4) the filter becomes torn.

It should also be noted that the system 20 can be used for liquid flushes even though it is out of filter material. However, solid flushes should be avoided.

When a new cassette 70 is installed, the change cassette indicator 90 will extinguish by interrupting power with the control power circuit breaker. A reset pulse will be produced either by the reed switch assembly 78, if the magnet and reed line up, or by resistor 228 and capacitor 230 if the magnet and reed do not line up.

In regard to the delay process function, the device 160C output goes high with the flush lever 28. Transistor 232 saturates preventing transistor 234 from saturating. Therefore, the cassette process relay 170 cannot pull in for approximately 27 seconds. This timer allows the system 20 to rinse, refill, open and close the flush valve assembly 58, and advance the filter material 82 before it starts its recirculation cycle.

When device 160C times out, the 160D output through diode 236 and resistor 238, saturates transistor 234 pulling in cassette process relay 170. The recirculating pump 68 gets powered through the rinse pump relay 166, the filter advance relay 172, and the cassette process relay 170. In regard to the main timer function, device 160D output goes high with the flush lever 28. Although transistor 240 is saturated, electrolytic cell relay 174 cannot be pulled in until the delay process function of device 160C ends. Then, through the cassette process relay 170, diode 242, and saturated transistor 240, electrolytic cell relay 174 pulls in. Electrolytic cell relay 174, diode 244, cassette process relay 170 are the conditions needed to pull in recirculating valve 61. Also, electrolytic cell relay 174 completes the power circuit to the electrolytic cell.

The main timer 160D interval as determined by resistors 246 and 248 and capacitor 250 is 240 seconds.

In regard to the effluent timer, at the end of 240 seconds, timing device 160D goes low which de-energizes electrolytic cell relay 174. Electrolytic cell relay 174 and cassette process relay 170 energize effluent valve 178. Also, timing device 160B starts timing at the end of 160D. Device 160B through diode 256 and resistor 238 keeps transistor 234 saturated and cassette process relay 170 energized. This keeps recirculating pump 68 going for an additional 60 seconds as determined by resistor 252 and capacitor 254.

With the recirculating pump on, and the effluent valve energized, the treated liquids are discharged overboard.

In regard to the flush lever disable, diode 256 and diode 236 serve another function. They sum-up the main timer and effluent timer function, and, through resistor 257 saturate transistor 180. Transistor 180 lights the yellow LED which is the processsing light 88. Also, through diode 236 and diode 256 a voltage higher than 2.5 volts is produced across resistor 258 when either the main timer or the effluent timer is timing, which electrically disables the flush lever switch. That is not flushing can be achieved while the device is processing.

A 6 amperes circuit breaker 48 is provided with each system 20 to protect the rinse pump 32. Rinse pump 32 actually draws approximately 15 amperes but, because the rinse pump is activated for a few seconds, the over current is ignored by this circuit breaker.

If, however, due to a failure, the rinse pump stayed on for longer than a few seconds, circuit breaker 48 will remove power from rinse pump 32 thus preventing floods. Also, circuit breaker 48 could be used to switch power off the rinse pump for servicing, troubleshooting, and the like.

A 3 ampere circuit breaker 49 is also provided to protect all other active components. Individual protection is achieved by energizing one major component at a time. For example, power is held off the recirculating pump while the filter is advanced, etc. This circuit breaker is also used to remove control power from the system for servicing, cassette changing, and the like.

A 25 ampere circuit breaker is recommended for installation as near as possible to the battery. This protects against catastrophic failures.

The system is designed to operate at a maximum pitch and roll angle of 30 degrees. This is deemed advisable in marine environments. At these extreme angles, it is necessary to change the operation of flush valve assembly 58 such that the bowl is allowed to empty into the cassette. To achieve this, a photon coupled interrupter module is employed. This device houses an infrared emitting diode 258 coupled with a silicon photo transistor 260. The gap in the housing is interrupted by an opaque flag. This flag allows the light from the emitting diode to saturate the photo transistor when the system is pitched forward or rolled side ways for more than 15 degrees. This function is provided by unit 262, resistor 264, resistor 266, resistor 268, capacitor 270 and PNP transistor 272. It operates in the following manner. If the system's pitch or roll angle is more than 15 degrees, and the rinse pump relay 166 is energized, transistor 272 pulls flush valve relay 168 in, and the flush valve relay 168 stays in for approximately 10 seconds. This function is inoperative at all other times.

The time sequence of the system is clearly depicted in FIG. 10 and the flow sequence is clearly shown in the block diagram of FIG. 8. The waste is treated in the following manner, when the flush valve assembly 58 is opened, the solid and liquid waste in the bowl is dumped through the opening 146 in the bottom of the bowl with the assistance of rinse water supplied from an external water source introduced into the bowl. The combination of solid waste and fluid fall through the openings in the processing module 56 and into the opening 96 in the upper side of cassette 76. It is deposited on the filter material 82 in alignment with the opening in the cassette where the solid waste is substantially collected with the fluid passing through the filter material to the bottom of the cassette. The take up roll assembly 86 is advanced drawing the filter material 82 and collected solid waste thereon into engagement therewith. The triangular, or other polyagonal configuration, of the take up roll outer member 102 assists in capturing the waste material on the take up roll. The filtered fluid is pumped through inlet tube 109 out of the cassette through connector 98 and then through hose 66 to valve assembly 62 and through recirculation valve 61. From there the fluid is pumped through tube 64 back into the processing module for further treatment therein by the electrolytic cell 56. The fluid is then passed again from the module into the cassette for further filtering. This filtering cycle between the cassette and the processing module continues through a predetermined period of time and thereafter the effluent value opens to permit the treated fluid to exit the system through effluent tube 63. In this manner, the waste can be collected and the fluid discharged from the system in a clean condition which is acceptable to EPA standards.

Thus the several aforenoted objects and advantages are more effectively attained. Although several somewhat preferred embodiments have been disclosed and described in detail herein, it should be understood that this invention is in no sense limited thereto and its scope is to be determined by that of the appended claims.

We claim:

1. A method of disposing of sewage waste within a self-contained flow-through system comprising; providing a toilet bowl adapted to receive human waste and fluid for diluting the waste, transporting the waste and rinsing the bowl, placing a removable filter cassette in alignment and in communication with the toilet bowl, filtering the fluid and separating particles of solid material from the fluid received from the bowl, storing the solid material in a compact manner in the cassette for subsequent disposal upon removal of the cassette from alignment with the toilet bowl, transporting fluid other than human waste fluid from an external source upon initiation of each waste treatment sequence through interconnected conduits in the system to fill the bowl after a flush, to transport and recirculate filtered fluid through the system for further waste disposal treatment and to direct the effluent fluid from the system thereafter, and controlling by control means the passage of the fluid through the system to facilitate the collection and disposal of sewage waste within the system in a predetermined waste treatment sequence with fluid from the external source being introduced into the system, flowing through and being discharged from the system in each operational sequence.

2. The invention in accordance with claim 1 wherein means is in the housing in position to sanitize and deodorize the recirculated fluid.

3. The invention in accordance with claim 2 wherein the means in the housing for sanitizing and deodorizing the recirculated fluid includes an electrolytic cell for converting the chloride normally found in human urine into chlorine compounds.

4. The invention in accordance with claim 1 wherein the control means includes a flush actuator and a flush valve and pump means including a rinse and refill pump responsive to activation of the flush actuator to cooperate with the flush valve in rinsing and refilling the toilet bowl, the pump means further including a recirculation pump and the control means including a recirculation valve responsive to the completion of the rinse and refill of the toilet bowl to operate and provide for recirculation of fluid through the system for a predetermined time, and the control means including an effluent valve actuated to open when the recirculating valve closes to direct the effluent fluid out of the system until the system is empty and ready for reuse.

5. The invention in accordance with claim 1 wherein substantially no treated fluid is stored within the system during non-use and the external source is a body of salt water.

6. The invention in accordance with claim 1 wherein the filter cassette includes a casing mounted in alignment with a discharge opening in the toilet bowl and having an opening therein in communication therewith, a supply of filter material in the cassette, take up means in the cassette in position to draw filter material from the filter supply into alignment with the opening in the cassette to receive and filter sewage waste from the toilet bowl and then to collect and store the filter material and accumulated solid waste material within the cassette.

7. The invention in accordance with claim 1 which has take up means in the cassette including a take up roll connectable to the control means for rolling up a predetermined portion of filter material and collected solid waste upon demand.

8. The invention in accordance with claim 7 wherein the take up roll has a polyagonal configuration to facilitate collection of the filter material and collected solid waste.

9. The invention in accordance with claim 1 wherein the control means includes a filter advance switch responsive to flushing of the toilet bowl to advance the filter means in the cassette with the filtered waste thereon to the storage means for storage thereof.

10. The invention in accordance with claim 1 wherein the filter means in the cassette includes an end indicator and the control means includes a filter end switch responsive to sensing of the filter end indicator to prevent further use for solid waste of the system until the cassette is replaced.

11. The invention in accordance with claim 1 wherein further waste disposal treatment is facilitated by use of a processing module replaceably mounted in the housing and connectable to the remaining components therein, the processing module including a flush valve operable to be opened to permit dumping of the contents of the toilet bowl therethrough and thereafter to be closed to permit refilling of the toilet bowl with fluid, and sanitizing and deodorizing means in communication with the recirculation valve to receive recirculated fluid for further treatment thereof.

12. The invention in accordance with claim 1 wherein pitch and roll protection means is provided to empty the bowl when the pitch and roll of the system is greater than a predetermined degree.

* * * * *

UNITED STATES PATENT AND TRADEMARK OFFICE

CERTIFICATE OF CORRECTION

PATENT NO. : 4,565,636

DATED : January 21, 1986

INVENTOR(S) : DeGraw, et al.

It is certified that error appears in the above-identified patent and that said Letters Patent is hereby corrected as shown below:

Column 1, Line 27, - "considerations" should read --consideration--;

Column 4, Line 52, - "ccomponents" should read --components--;

Column 6, Line 64, - "show" should read --shown--;

Column 8, Line 30, - "rfll" should read --refill--;

Column 9, Line 11, - "supress" should read --suppress--;

Column 12, Line 25, - "76" should read --70--.

Signed and Sealed this

*Thirteenth* Day of *May 1986*

[SEAL]

*Attest:*

*Attesting Officer*

DONALD J. QUIGG

*Commissioner of Patents and Trademarks*